US007302069B2

(12) United States Patent
Niederdränk et al.

(10) Patent No.: US 7,302,069 B2
(45) Date of Patent: Nov. 27, 2007

(54) HEARING AID AND METHOD FOR ADJUSTING A HEARING AID

(75) Inventors: Torsten Niederdränk, Erlangen (DE); Christian Weistenhöfer, Bubenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 497 days.

(21) Appl. No.: 10/944,589

(22) Filed: Sep. 17, 2004

(65) Prior Publication Data

US 2005/0105741 A1 May 19, 2005

(30) Foreign Application Priority Data

Sep. 18, 2003 (DE) ..... 103 43 291

(51) Int. Cl.
*H04R 25/00* (2006.01)
*H04R 29/00* (2006.01)

(52) U.S. Cl. ..... 381/312; 381/60

(58) Field of Classification Search ..... 381/312, 381/328, 60, 23.1; 600/559
See application file for complete search history.

(56) References Cited

U.S. PATENT DOCUMENTS 6,554,762 B2 * 4/2003 Leysieffer ..... 600/25

FOREIGN PATENT DOCUMENTS

| | | |
|---|---|---|
| DE | 41 28 172 C2 | 3/1993 |
| DE | 101 04 711 A1 | 4/2002 |
| DE | 100 41 726 C1 | 5/2002 |
| WO | WO 00/28784 | 5/2000 |

* cited by examiner

*Primary Examiner*—Curtis Kuntz
*Assistant Examiner*—Tuan Duc Nguyen

(57) ABSTRACT

The process of adapting a hearing aid to its wearer is to be simplified. To this end the acoustic conditions in the auditory canal, especially the acoustic impedance, are estimated by measuring the input impedance of the earpiece on the hearing aid. For adjusting the hearing aid it is worthwhile using the mechanical resonance of the system of hearing aid and auditory canal which can be detected with the aid of the input impedance. This is produced by a simplified equivalent circuit diagram from which the corresponding acoustic variables can be obtained.

4 Claims, 1 Drawing Sheet

HEARING AID AND METHOD FOR ADJUSTING A HEARING AID

CROSS REFERENCE TO RELATED APPLICATIONS

This application claims priority to the German application No. 10343291.4, filed Sep. 18, 2003 and which is incorporated by reference herein in its entirety.

FIELD OF INVENTION

The current invention relates to a hearing aid with a signal processing unit for processing an input signal into an output signal and a sound conversion device for converting the output signal of the signal processing device into a sound signal. In addition the present invention relates to a method of adapting a hearing aid.

BACKGROUND OF INVENTION

For adapting hearing aids the actual sound pressure generated by the hearing aid produced in the patient is of great interest. The individual form of the auditory canal means that this sound pressure can vary greatly from the sound pressure which was measured under laboratory conditions. A normal coupler refers to a unit which simulates the auditory canal, the eardrum and the tympanic canal of a person's hearing and is used for the purpose of adjusting hearing aids.

SUMMARY OF INVENTION

It is precisely in the frequency range of below 8 Khz which is of interest for hearing aids that an individual volume deviating from that of the normal coupler has a very great effect. Since the normal sound pressure curves are used as a rule for adaptation, large individual deviations can lead, despite correct use of the adaptation formulae, to incorrect adaptation and non-acceptance of the hearing aid.

Publication DE 41 28 172 describes a digital hearing aid in which an acoustic sensor records the reaction of the inner ear to measurement tones issued by an electro-acoustic converter. The otoacoustic emissions produced by the inner ear are digitized and subsequently subjected to a comparison is with stored data corresponding to the previous hearing capability data. From the comparison the microcomputer makes any necessary correction to the stored data. A similar hearing aid for in-situ measurement is presented in Publication WO 00/28784.

In addition a hearing aid device is also known from Publication DE 101 04 711 in which an earpiece is used to record the sound field in the auditory canal of the person wearing the hearing aid. In this case the earpiece has a dual function and also operates as receiver of an acoustic input signal which represents the sound field in the auditory canal of the person wearing the hearing aid and converts it into an electrical input signal. After appropriate further processing the electrical input signal is used for adapting the hearing aid device to a person wearing the hearing aid. The adaptation is undertaken here by measuring the voltage which is caused by the acoustic input signal.

Furthermore Patent DE 100 41 726 C1 describes an implantable hearing system with means for adaptation of the coupling quality. In this case the hearing system is provided for objective determination of the coupling quality of the output converter with an arrangement for measuring mechanical impedance of the biological load structure coupled to the output converter in the implanted state. The impedance measurement arrangement features an arrangement for measuring the electrical input impedance of the electromechanical output converter(s) coupled to the biological load structure.

An object of the present invention is to disclose a hearing aid which can be adapted with as little effort as possible exactly to the auditory canal of a person wearing a hearing aid. A further object is to specify an appropriate method for adaptation of a hearing aid.

In accordance with the invention this objects are achieved by the claims.

The underlying idea of the invention is that for adaptation the individual sound pressure produced in the auditory canal of the patient must be correctly determined. The sound pressure can be determined indirectly from the auditory canal impedance, that is the impedance against which the output of the hearing aid operates. To this end a hearing aid model is used as is usually contained in the adaptation software.

In accordance with a preferred inventive embodiment of a hearing aid, the acoustic impedance of the auditory canal before the sound converter device can be determined in the signal processing device from the electrical input impedance. This means that it is possible to dispense with a separate acoustic converter to determine the acoustic impedance.

A mechanical resonance is preferably determined in the signal processing device from the graph of the electrical input impedance. In the signal processing device a shift of the mechanical resonance can then be used for automatic correction of the normal frequency curve of the hearing aid.

BRIEF DESCRIPTION OF THE DRAWINGS

The invention will now be explained in greater detail on the basis o f the enclosed drawings, which show.

DETAILED DESCRIPTION OF INVENTION

The exemplary embodiments illustrated in greater detail below represent preferred forms of embodiment of the present invention.

Figure 1:
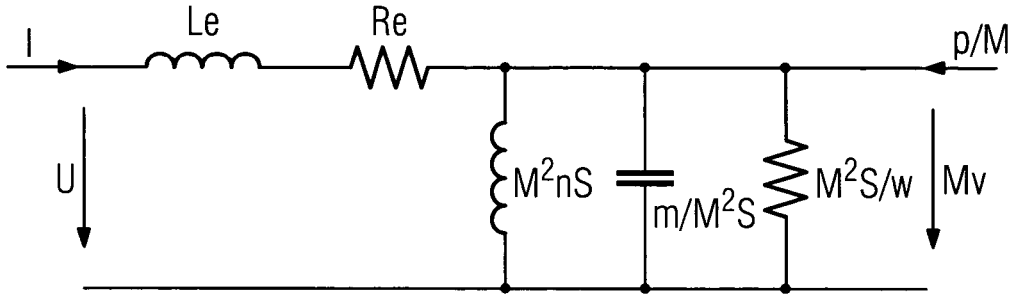
FIG. 1 a simplified equivalent circuit diagram of an electromagnetic earpiece FIG. 2 a frequency function of the amount of the electrical input impedance of a typical hearing aid earpiece.

In accordance with the invention use is made of the fact that with an electromagnetic converter its mechanical elements and the vibrating masses coupled to them influence the electrical impedance, i.e. the ratio of the voltage U to the current I. A corresponding simplified equivalent circuit diagram of the electromagnetic earpiece is shown in FIG. 1. Accordingly the electrical impedance U/I of the earpiece is produced from a series circuit of the coil inductivity Le and the direct current resistance Re with a parallel circuit comprising an inductance $M^2nS$, a capacitance $m/M^2S$ and a resistance $M^2S/w$. In this case M means the electromagnetic converter constant, S the membrane surface, n the compliance of the membrane curtain and of the load volume, m the membrane mass and w the losses. All elements are related to electrical variables for this purpose.

The output side of the four-pole equivalent circuit shown in FIG. 1 is determined by the variables p/M in accordance with a current and Mv in accordance with a voltage. In this case p means the sound pressure and v the sound velocity.

Figure 2:
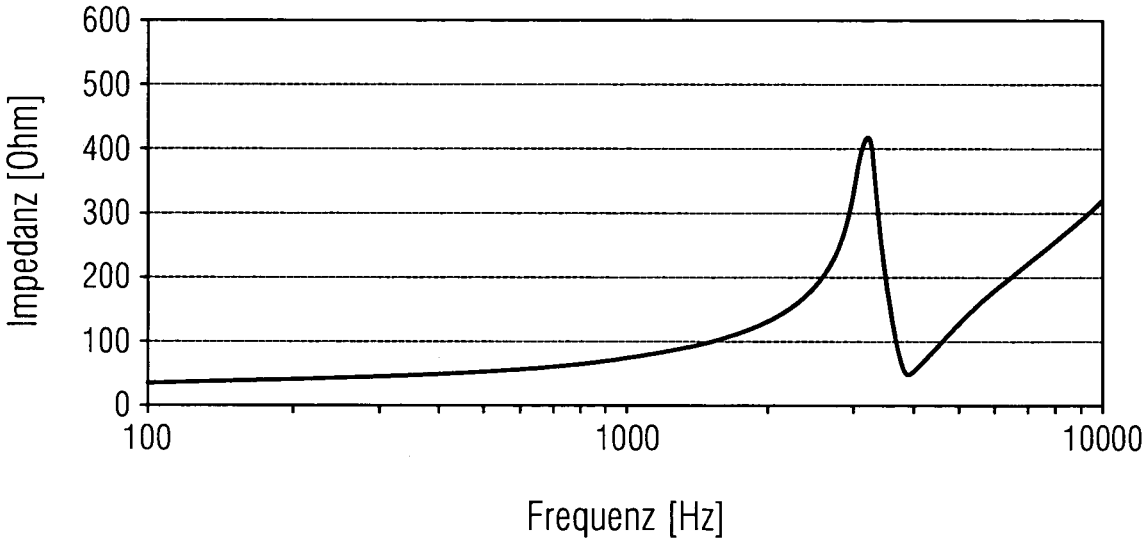

The equivalent circuit makes it very evident that a mechanical resonance of the system is directly reflected in the electrical impedance. This also explains the graph of the amount shown in FIG. 2 of the electrical input impedance of a typical hearing aid earpiece. In the low-frequency area the direct current resistance Re is decisive, whereas in the high-frequency area inductive behavior, primarily caused by the coil inductivity Le with an increase of around 6 dB/octave predominates. In the mid frequency area the components of FIG. 1 connected in parallel which represent the mechanical system become apparent. They lead to a typical resonance curve of the impedance spectrum as a result of the mechanical resonance. In the case of FIG. 2 the resonance peak lies at around 3200 Hz.

The frequency of the mechanical resonance is essentially determined by the mass of the moved parts of the earpiece, e.g. the membrane, the membrane curtain and the load volume, especially the auditory canal volume. If the frequency curve of the electrical input impedance of the earpiece located at the normal coupler is known, individual deviations from the normal volume based on a shift in the mechanical resonance frequency can be estimated. If the residual volume of the auditory canals is smaller than the normal volume, the resonant frequency shifts upwards. Otherwise it shifts downwards. To correct the normal frequency response the deviation values are fed to the adaptation software.

The main advantage of the method in accordance with the invention lies in its ease of handling. This is because no additional measuring device is necessary for determining the acoustic conditions in the auditory canal. Instead, the sound pressure in the auditory canal can be determined indirectly by determining the electrical input impedance of the earpiece with the aid of the signal processing chip of the hearing aid. In this case the electrical impedance can be measured in normal operation, i.e. in a normal environment with natural sound sources, if the output signal of the signal processing chip has enough energy in the frequency ranges which are of interest. If however this is not the case, when the natural sound source for example is too quiet or is concealed too strongly, adaptation with artificial acoustic irradiation of the hearing aid is necessary.

The invention claimed is:

1. A hearing aid, comprising:

a signal processing device for processing an input signal into an output signal; and a sound converter device for converting the output signal of the signal processing device into a sound signal, wherein the signal processing device is adapted to:

determine the electrical input impedance of the sound converter device serving as an acoustic impedance parameter, determine a mechanical resonant frequency using a curve progression of the electrical input impedance, and adjust a factory setting of the frequency response of the hearing aid using a shift of the mechanical resonant frequency.

2. The hearing aid according to claim 1, wherein the signal processing device is adapted to determine an acoustic impedance of an auditory canal adjacent to the sound converter using the electrical impedance.

3. A method for adjusting a hearing aid having a sound converter device for generating a sound signal, the method comprising:

arranging the hearing aid in an auditory canal of a patient;

determining an electrical input impedance of the sound converter serving as an acoustic impedance parameter of the auditory canal;

determining a mechanical resonant frequency using a curve progression of the electrical input impedance; and adjusting a factory setting of the frequency response of the hearing aid using a shift of the mechanical resonant frequency relative to a reference resonant frequency.

4. The method according to claim 3, wherein an acoustic impedance of the auditory canal adjacent to the sound converter device is determined using the electrical input impedance.

* * * * *